US007129844B2

(12) United States Patent
Pan

(10) Patent No.: US 7,129,844 B2
(45) Date of Patent: Oct. 31, 2006

(54) REMOTE COMMUNICATIONS DEVICES, WIRELESS COMMUNICATIONS SYSTEMS, REMOTE COMMUNICATIONS DEVICE OPERABLE METHODS, AND RETAIL MONITORING METHODS

(75) Inventor: Alfred I-Tsung Pan, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 123 days.

(21) Appl. No.: 10/903,079

(22) Filed: Jul. 29, 2004

(65) Prior Publication Data

US 2006/0022829 A1 Feb. 2, 2006

(51) Int. Cl.
*G08B 13/14* (2006.01)

(52) U.S. Cl. ..... 340/572.3; 340/572.1; 340/539.1; 340/568.1; 340/825.36; 340/825.69; 340/10.1

(58) Field of Classification Search ..... 340/572.3, 340/572.1, 572.4, 539.1, 539.13, 539.17, 340/568.1, 825.36, 825.49, 825.69, 10.1, 340/10.3; 235/383, 384, 385, 492
See application file for complete search history.

(56) References Cited

U.S. PATENT DOCUMENTS 5,745,036 A 4/1998 Clare
5,955,951 A * 9/1999 Wischerop et al. ..... 340/572.8
6,342,830 B1 * 1/2002 Want et al. ..... 340/10.1
6,476,720 B1 * 11/2002 Andersen et al. ..... 340/572.1
6,598,791 B1 7/2003 Bellis, Jr. et al.
6,659,344 B1 12/2003 Otto et al.
6,681,989 B1 1/2004 Bodin
6,714,133 B1 3/2004 Hum et al.
6,830,181 B1 * 12/2004 Bennett ..... 235/440
6,883,710 B1 * 4/2005 Chung ..... 235/385
2002/0038267 A1 3/2002 Can et al.
2003/0135417 A1 7/2003 Bodin
2003/0214387 A1 11/2003 Giaccherini

OTHER PUBLICATIONS

"Clothier Benneton adopts Philip's RFID technology for 'smart' Labels;" www.eetimes.com/article/printableArticle.jhtml?articleID= 9901084; Yoshida, Junko; EE Times; Mar. 12, 2003; 2 pps.
"Benneton backs off RFID deployment;" www.eetimes.com/article/printableArticle.jhtml?articleID= 12804031; EE Times; Apr. 5, 2003; 1 pp.
"Introduction to PMCm"; www.axxontc.com; Jul. 28, 2004; 3 pps.
"Submicron Nonvolatile Memory Cell Based on Reversible Phase Transition in Chalcogenide Glasses"; Nakayama et al.; Jpn J. Appl. Phys., vol. 39; 2000; pp. 6517-6161.

(Continued)

*Primary Examiner*—Hung Nguyen

(57) ABSTRACT

Remote communications devices, wireless communications systems, remote communications device operable methods, and retail article monitoring methods are described. According to one embodiment, a remote communications device includes communications circuitry configured to implement wireless communications with respect to another wireless communications device and a configurable portion configured to be altered, and wherein the remote communications device is configured to respond to wireless interrogation signals from the another wireless communications device, and incident at the remote communications device with the configurable portion in an unaltered condition and wherein the remote communications device is insensitive to the wireless interrogation signals from the another wireless communications device and incident at the remote communications device with the configurable portion in an altered condition.

41 Claims, 3 Drawing Sheets

OTHER PUBLICATIONS

"Nonvolatile Memory Based on Phase Transition in Chalcogenide Thin Film"; Nakayama et al.; Jpn.J.Appl.Phys., vol.32; 1993; pp. 564-569.
"Nonvolatile Memory Based on Phase Change in Se-Sb-Te Glass"; Nakayama et al.; Jpn.J.Appl.Phys., vol. 42; 2003; pp. 401-408.
"Non-volatile memory cells based on ZnxCd1-xS ferroelectric Schottky diodes"; van de Sluis, P.; Applied Physics Letters; vol. 82, No. 23; Jun. 9, 2003; pp. 4089-4091.
"PMCm, An Introduction to Programmable Metallization Cell Memory Devices"; www.axontc.com; Jul. 28, 2004; 24 pp.

* cited by examiner

REMOTE COMMUNICATIONS DEVICES, WIRELESS COMMUNICATIONS SYSTEMS, REMOTE COMMUNICATIONS DEVICE OPERABLE METHODS, AND RETAIL MONITORING METHODS

FIELD OF THE DISCLOSURE

Aspects of the disclosure relate to remote communications devices, wireless communications systems, remote communications device operable methods, and retail article monitoring methods.

BACKGROUND OF THE DISCLOSURE

Wireless communications devices are utilized in an increasing number of applications for data communications. More recently, arrangements have been developed wherein numerous communications devices, such as tags, are provided to communicate with an interrogator. The interrogator may interrogate the devices and wait for reply signals from the appropriate devices. In some arrangements, identification operations are provided of the devices themselves and/or objects associated with the devices. Some identification arrangements may be referred to as radio frequency identification device (RFID) arrangements.

In one exemplary identification arrangement, integrated circuits and associated wireless communications circuitry are incorporated into smart labels attached to garments during manufacturing. The circuits may store information about the style, size, color and intended destination of the items. The stored information may be used to locate individual garments in a store using smart shelves and dressing rooms. When used at point of sale, the devices may automatically register sales and returns and also feedback information to the company's ordering system. Further, the devices may be used to discourage theft in some implementations.

However, there is concern regarding privacy of customers involving usage of the devices embedded or otherwise associated with purchased items for communications after sales of the articles with or without the knowledge of the customers.

At least some aspects of the disclosure provide wireless communications devices, systems and methods which provide improvements with respect to communications arrangements.

SUMMARY

Aspects of the disclosure relate to remote communications devices, wireless communications systems, remote communications device operable methods, and retail article monitoring methods.

According to one embodiment, a remote communications device comprises communications circuitry configured to implement wireless communications with respect to another wireless communications device and a configurable portion configured to be altered, and wherein the remote communications device is configured to respond to wireless interrogation signals from the another wireless communications device and incident at the remote communications device with the configurable portion in an unaltered condition, and wherein the remote communications device is insensitive to the wireless interrogation signals from the another wireless communications device and incident at the remote communications device with the configurable portion in an altered condition.

According to an additional embodiment, a remote communications device operable method comprises providing a remote communications device, receiving a plurality of wireless interrogation signals from a base station using the remote communications device present within a communications range of the base station, using the remote communications device in an unaltered configuration, outputting a plurality of wireless identification signals responsive to the receiving of the wireless interrogation signals, reconfiguring the remote communications device from the unaltered configuration to an altered configuration after the outputting; and wherein the reconfiguring to the altered configuration renders the remote communications device insensitive to the wireless interrogation signals received while the remote communications device is present within a communications range of the base station.

Other embodiments and aspects are described as is apparent from the following discussion.

DETAILED DESCRIPTION

At least some aspects of the disclosure provide wireless communications systems including a base station and one or more remote communications devices. The base station may be arranged to communicate with individual ones of the remote communications devices using wireless communications. According to one embodiment, individual ones of the remote communications devices are configured to be activated at a first moment in time wherein wireless communications with respect to the device are possible and disabled or deactivated at another moment in time wherein wireless communications with respect to the device are disabled. In one implementation, the remote communications devices may be deactivated at a desired moment in time (e.g., following the sale of an article associated with the remote communications device). Other implementations and aspects of the disclosure are described herein.

Figure 1:
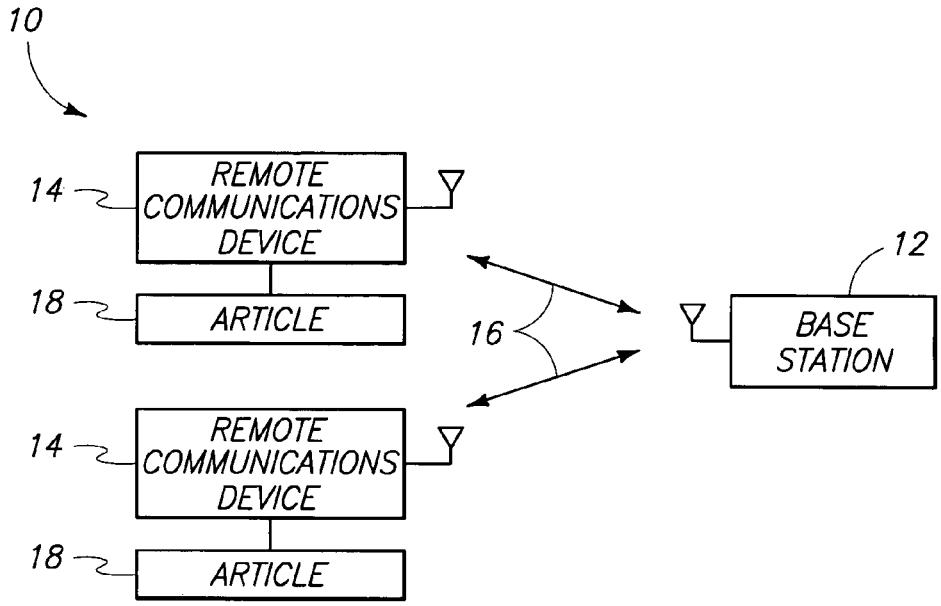
FIG. 1 is a functional block diagram of an exemplary wireless communications system according to one embodiment.

Referring to FIG. 1, an exemplary wireless communications system 10 is illustrated according to one embodiment. The depicted system 10 includes a plurality of wireless communications devices including a base station 12 and one or more remote communications devices 14 remotely located with respect to the base station 12. In some arrangements, base station 12 provides a communications range for communications with respect to devices 14 within the communications range. Remote communications devices 14 may be portable devices (e.g., tags) in some arrangements which may be moved in and out of the communications range of the base station 12 from time to time.

Base station 12 and remote communications devices 14 are arranged to implement wireless communications 16 in the exemplary embodiment. Wireless communications 16 may include electromagnetic energy including radio frequency or infrared communications in one embodiment. In other embodiments, other forms of wireless communications 16 may be used. Exemplary radio frequency wireless communications include communications at microwave frequencies (e.g., 900 MHz–2.5 GHz) in one embodiment. Wireless communications 16 may include forward communications outputted from base station 12 and return communications outputted from the present remote communications devices 14. Exemplary remote communications devices 14 may be configured to backscatter modulate radio frequency energy to provide the return communications in one embodiment. In another embodiment, the remote communications devices 14 may include active transmitter circuitry to formulate the return communications.

As shown, remote communications devices 14 may be individually associated with respective articles 18. Exemplary articles 18 include any items with which remote communications devices 14 may be associated. For example, articles 18 may include consumer items for purchase in a retail store and base station 12 may be provided within the retail store to monitor the presence and/or absence of devices 14 and/or articles 18. Remote communications devices 14 configured as tags may be attached or embedded within articles 18 in exemplary embodiments. Other associations of devices 14 and articles 18 are possible.

In an exemplary identification implementation, forward wireless signals may include interrogation or polling signals outputted by base station 12. Devices 14 which are provided within the communications range of base station 12 may receive the forward wireless signals and respond by communicating return wireless signals responsive to reception of the forward wireless signals in one transponder embodiment. The return wireless signals may identify (e.g., uniquely) one or more of the remote communications devices 14 and/or the respective articles 18 associated with the remote communications devices 14 and be referred to as identification signals in one identification embodiment. Exemplary identification implementations of system 10 may be referred to as radio frequency identification device (RFID) arrangements and devices 14 may be referred to as RFID tags in the RFID arrangements. Other communications apart from identification operations may be implemented in other embodiments.

Figure 2:
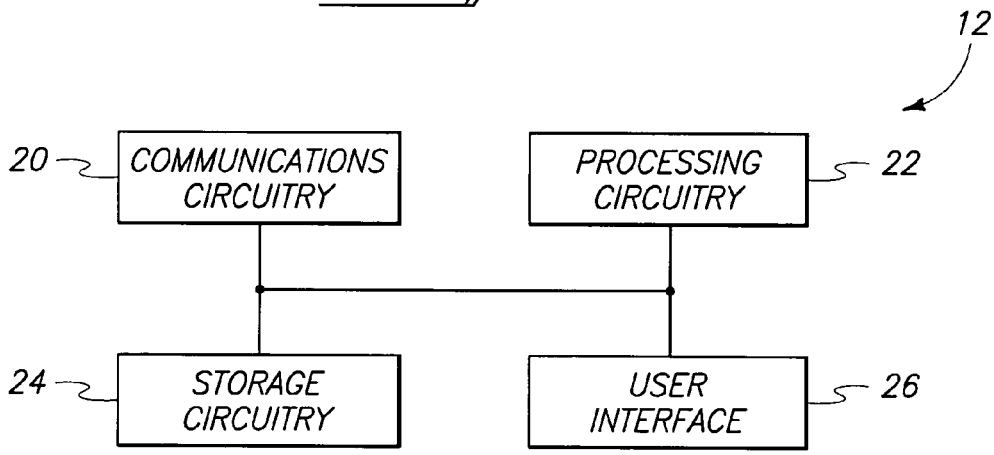
FIG. 2 is a functional block diagram of an exemplary base station according to one embodiment.

Referring to FIG. 2, an exemplary configuration of base station 12 is shown. Base station 12 includes communications circuitry 20, processing circuitry 22, storage circuitry 24 and a user interface 26 in the depicted embodiment. Other configurations of base station 12 including more, less or alternative components are possible.

Communications circuitry 20 is arranged to implement wireless communications 16 with respect to remote communications devices 14. Communications circuitry 20 may include a transceiver, antenna and any other components or circuitry for implementing the wireless communications.

In one embodiment, processing circuitry 22 is arranged to process data, control data access and storage, issue commands, and control other desired operations. Processing circuitry 22 may comprise circuitry configured to implement desired programming provided by appropriate media in at least one embodiment. For example, the processing circuitry may be implemented as one or more of a processor and/or other structure configured to execute executable instructions including, for example, software and/or firmware instructions, and/or hardware circuitry. Exemplary embodiments of processing circuitry include hardware logic, PGA, FPGA, ASIC, state machines, and/or other structures alone or in combination with a processor. These examples of processing circuitry 22 are for illustration and other configurations are possible.

Storage circuitry 24 is configured to store electronic data and/or programming such as executable instructions (e.g., software and/or firmware), data, or other digital information and may include processor-usable media. Processor-usable media includes any article of manufacture which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

User interface 26 may include a display or other device to communicate information regarding system 10 to a user. User interface 26 may also include a user input device (e.g., keyboard, mouse, etc.) configured to receive user inputs. In an exemplary retail store embodiment, user interface 26 may be proximately located to a check-out unit.

With further respect to an exemplary retail store implementation, wireless communications system 10 may be arranged to assist with inventory monitoring, location of articles 18, and/or theft deterrence. In one embodiment, storage circuitry 24 may maintain a database of devices 14 and/or respective articles 18 which are supposed to be present within the store (which may correspond to the communications range of base station 12). When an article 18 is purchased, the database may be updated to reflect the purchase. Further, the database may be updated to reflect otherwise missing articles 18. Interrogation signals of devices 14 may be outputted by base station 12 to monitor presence and/or location of articles 18 in expected inventory. Identification signals received from devices 14 may be compared with the updated database to identify any discrepancies in one exemplary inventory monitoring arrangement. In a more specific example, a theft may be indicated if an article 18 which is expected to be in inventory or otherwise present fails to respond to interrogations. If interrogations are repeated at sufficiently small intervals, then the failure to receive a response from a given device 14 expected to reply may provide real-time or near real-time information regarding a possible theft or other improper deactivation of a device 14.

According to exemplary aspects of the disclosure, remote communications devices 14 may be individually altered from an unaltered, activated or operable state or condition wherein wireless communications 16 with respect to the device 14 are enabled to an altered, deactivated, inoperable or disabled state or condition wherein wireless communications 16 with respect to the device 14 are disabled. For example, in one retail implementation, the respective device 14 of an article 18 may be in an activated state at an initial moment in time (e.g., prior to purchase of the article 18) wherein base station 18 may communicate with the device 14. At a subsequent moment in time (e.g., when the article 18 is purchased), the respective device 14 may be deactivated to preclude wireless communications 16 from base station 12 with respect to the device 14. In other arrangements or implementations, devices 14 may be individually deactivated at other desired moments in time or for other reasons. As mentioned above, if a device 14 is deactivated prior to purchase or other expected deactivation (e.g., by a thief), the device 14 would fail to respond to interrogation signals and the failure would be detected by processing circuitry 22 of base station 12, for example, by a comparison of responses with the contents of the database. Processing circuitry 22 may be thereafter arranged to signal personnel of the retail store or take other appropriate action.

Inactivation of a remote communications device 14 may in at least some embodiments refer to rendering a device 14 nonresponsive to received electromagnetic energy typically used during operable communications with base station 12 during an activated state of the device 14. For example, the device 14 may be responsive to wireless communications 16 incident at the device 14 and having a predefined characteristic (e.g., voltage, frequency, etc.) during operations in an activated state, and not be responsive (i.e., insensitive) to the wireless communications 16 incident at device 14 and having the predefined characteristic once the device 14 is rendered inoperable. The nonresponsiveness of a deactivated device 14 may result from a disablement of the ability of device 14 to receive wireless communications 16, process received wireless communications 16, and/or output wireless communications 16 in exemplary embodiments. Exemplary deactivation aspects of a device 14 are described further below.

In some embodiments, deactivation of a given remote communications device 14 may be considered to be permanent wherein some or all of wireless communications 16 with respect to the given device 14 are precluded after the deactivation. Permanent deactivation may refer in at least some embodiments to configurations wherein reactivation to again enable the disabled wireless communications 16 with respect to device 14 is not possible or would otherwise involve significant effort, repair and/or reconstruction to render the device 14 into an activated state which would normally not be provided during normal operation as opposed to merely an easily facilitated selectable state of activation and deactivation of the device 14.

Figure 3:
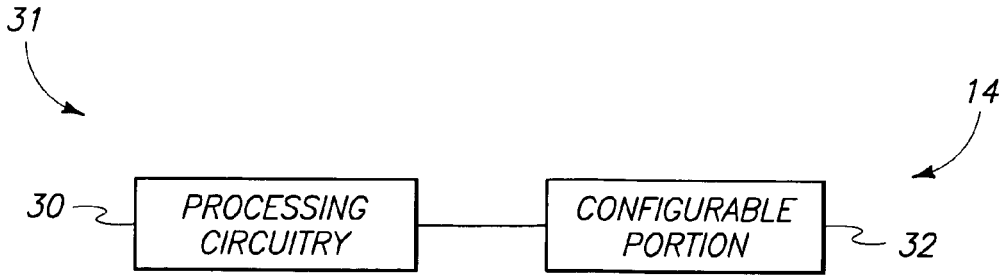
FIG. 3 is a functional block diagram of an exemplary remote communications device according to one embodiment.

Referring to FIG. 3, an exemplary configuration of a remote communications device 14 capable of being partially or wholly deactivated is illustrated. The depicted device 14 includes processing circuitry 30 and a configurable portion 32. Processing circuitry 30 may be arranged to implement wireless communications 16 including processing received forward wireless signals and formulating return wireless signals responsive to the processing. Processing circuitry 30 configured to implement wireless communications 16 may be referred to as communications circuitry 31. Communications circuitry 31 may additionally comprise other components or circuitry, such as an antenna (not shown in FIG. 3), for implementing wireless communications.

Configurable portion 32 refers to a portion of remote communications device 14 which may be altered or reconfigured to alter the device 14 from the activated state to the deactivated state. As described below, configurable portion 32 may in some device arrangements include or affect electrical circuitry configured to implement wireless communications. Illustrative embodiments of configurable portion 32 are described below with respect to FIGS. 4 and 5 although any other suitable configurations capable of providing the desired deactivation of the device 14 may be utilized or implemented.

Figure 4:
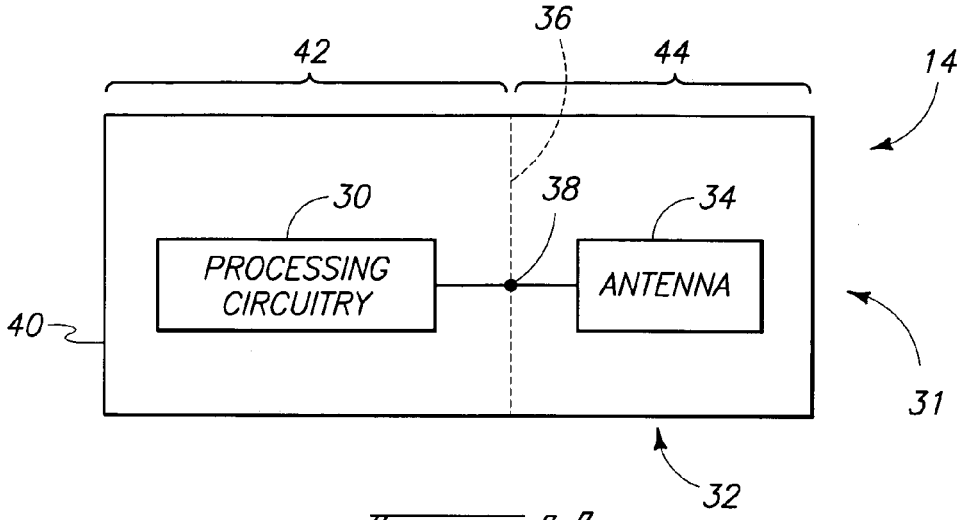
FIG. 4 is an illustrative representation of one possible implementation of a remote communications device according to one embodiment.

Referring to FIG. 4, a remote communications device 14 may include a substrate 40 to support components and/or circuitry of device 14. An exemplary substrate 40 may include a label of article 18 in one implementation and comprise plastic, paper, or other appropriate material. In the illustrated embodiment, substrate 40 may support communications circuitry 31 including processing circuitry 30 and an antenna 34 in the depicted configuration. Substrate 40 includes a base portion 42 and a removable portion 44 wherein configurable portion 32 corresponds to removable portion 44 in the depicted embodiment.

A boundary 36 (e.g., perforation) may define the respective base portion 42 and removable portion 44. In the activated state or condition of device 14, configurable portion 32 comprising removable portion 44 is coupled (e.g., integrally or otherwise associated) with base portion 42. In one embodiment, a conductive adhesive or other suitable conductor 38 electrically connects processing circuitry 30 and antenna 34 during operations of device 14 in the activated state. During reconfiguration or alteration of device 14 from the activated state to the deactivated state, removable portion 44 may be separated from base portion 42 at boundary 36.

As mentioned above, communications circuitry 31 may be supported by substrate 40 in one embodiment. In the illustrated configuration, portions of communications circuitry 31 are coupled with respective portions 42, 44 of substrate 40. Following removal of the removable portion 44 from base portion 42, the electrical connection provided by conductor 38 is broken electrically isolating respective circuitry of the portions 42, 44.

In accordance with the depicted exemplary configuration, removal of portion 44 from base portion 42 renders device 14 insensitive to wireless communications 16 with respect to base station 12. More specifically, following the removal, processing circuitry 30 is electrically isolated from antenna 34 rendering device 14 insensitive to previously implemented wireless communications 16. In other embodiments, electrical circuitry of device 14 other than processing circuitry 30 and antenna 34 may be coupled with respective portions 42, 44 to provide a desired deactivation upon separation of removable portion 44 from base portion 42.

Figure 5:
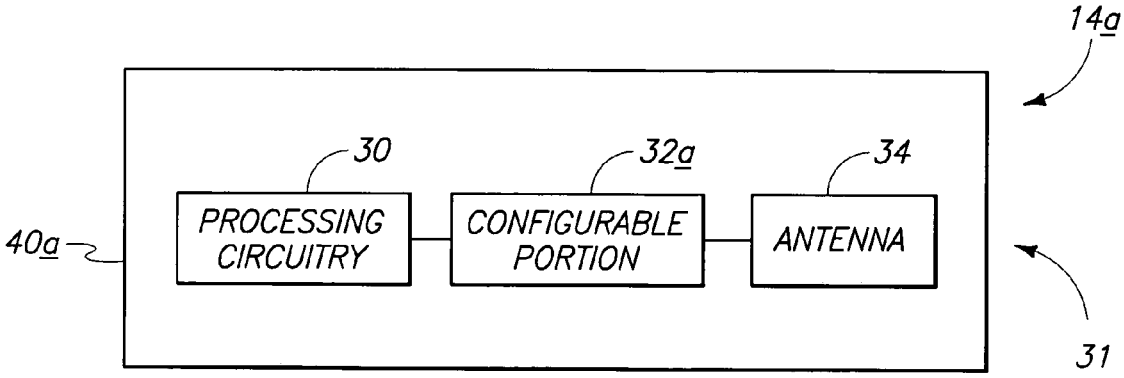
FIG. 5 is an illustrative representation of another possible implementation of a remote communications device according to one embodiment.

Referring to FIG. 5, an alternative configuration of configurable portion 32*a* is described wherein like numerals represent like components and/or circuitry with differences therebetween being represented by a suffix, such as "a." In the illustrated embodiment, remote communications device 14*a* includes a unitary substrate 40*a* which supports processing circuitry 30, configurable portion 32*a*, and an antenna 34. In the depicted illustration, configurable portion 32*a* comprises circuitry intermediate processing circuitry 30 and antenna 34. In an activated state of device 14*a*, configurable portion 32*a* is provided in one of open and closed circuit states (e.g., portion 32*a* is unaltered), and in a deactivated state of device 14*a*, configurable portion 32*a* is provided in an other of the open and closed circuit states (e.g., portion 32*a* is altered).

In the depicted embodiment of device 14*a* in the activated state, configurable portion 32*a* is in a closed circuit state to provide electrical connection of processing circuitry 30 and antenna 34. In the deactivated state of device 14*a*, configurable portion 32*a* is in an open circuit state to electrically isolate processing circuitry 30 and antenna 34. The illustrated arrangement of configurable portion 32*a* coupling processing circuitry 30 and antenna 34 is exemplary and other configurations are possible wherein configurable portion 32*a* is electrically coupled with other circuitry to implement the desired activation and deactivation of remote communications device 14*a*.

In the embodiment of FIG. 5, configurable portion 32*a* may be implemented as a fusable link comprising an electrical circuit to provide the configurable open and closed circuit conditions. For example, in an initial (e.g., unaltered) state or condition, the fusable link may have a first resistance (i.e., effectively corresponding to one of open and closed circuits) and a second resistance (i.e., effectively corresponding to an other of the open and closed circuits) in a second (e.g., altered) state or condition.

According to one aspect, electromagnetic energy may be utilized to alter the configurable portion 32*a* from the unaltered condition to the altered condition. In the described exemplary embodiment, the electromagnetic energy may change the resistance of the fusable link from the first resistance to the second resistance. For example, electromagnetic energy having a different characteristic (e.g., amplitude, frequency and/or duration) than electromagnetic energy used to implement wireless communications 16 may be used to change the resistance of the fusable link.

In one possible implementation, wireless communications 16 may be generated by the base station 12 using electrical energy of a first wattage. In addition, electromagnetic energy having a larger amplitude generated by electrical energy of base station 12 having a second wattage greater than the first wattage may be used to change the resistance of the fusable link. According to the exemplary retail embodiment, at the time of purchase of an article 18, base station 12 may switch operation from interrogation operations using electromagnetic energy of the reduced amplitude to expose device 14 associated with an article 18 being purchased to the electromagnetic energy of the increased amplitude to implement the reconfiguration operations.

Electromagnetic energy of other characteristics (e.g., frequency) may be used to implement wireless communications 16 and/or reconfiguration operations in other embodiments. In another example, the duration of an emission of electromagnetic energy from base station 12 may be lengthened to implement the reconfigurations. More specifically, a duration of an electromagnetic emission from base station 12 may be lengthened for reconfiguration of configurable portion 32*a* compared with a duration of emissions for wireless communications 16. The emitted energy may be stored in device 14*a* (e.g., using a capacitor electrically coupled with the configurable portion 32*a*) and reconfiguration of configurable portion 32*a* occurs after the lengthened emission of the electromagnetic energy and sufficient storage of the energy. Other embodiments are possible to reconfigure portion 32*a* using electromagnetic or other energy.

In one embodiment, the communications circuitry 31 of devices 14, 14*a* is sensitive to electromagnetic energy having a characteristic (e.g., energy level) of the wireless communications 16 with the respective configurable portions 32, 32*a* provided in an unaltered state, and insensitive to the electromagnetic energy having the same characteristic with the respective configurable portion 32, 32*a* in the altered state. In the unaltered state, the remote communications devices 14, 14*a* are responsive to wireless communications 16 from base station 12, while in an altered state, the remote communications devices 14, 14*a* may be considered to be nonresponsive to wireless communications 16.

In some exemplary embodiments of wireless communications system 10, the relative energy received by antenna 34 may be relatively low. In such arrangements, configurable portions 32*a* comprising fusable link configurations which are activated by relatively low amounts of energy may be used. For example, a resistance of the configurable portion 32*a* comprising a fusable link may be switched from 10 kΩ to 100 Ω in 5 nsec with electrical energy of 0.5 Volts and approximately 0.1 mA resulting from electromagnetic energy received via antenna 34 from base station 12 or other suitable source. More specifically, a small forward bias may result producing an electrodeposited conduction pathway from cathode to anode which rapidly reduces resistance. For silver-doped GeSe and silver-doped GeS, the threshold can be as low as 0.18 Volts and the programming currents can be as low as 1 μA with a change in resistance from >2 MΩ to 18 kΩ. Additional details regarding this exemplary configurable portion 32*a* are described in "Non-Volatile Memory Cells Based On $Zn_xCd_{1-x}S$ Ferroelectric Schottky Diodes;" P. Sluis; Applied Physics Letters, Vol. 82, 2003; p 4089, the teachings of which are incorporated herein by reference.

Another exemplary class of material which may be used to implement configurable portion 32*a* comprising a fusable link includes chalcogenide glass. Compared with the above-mentioned materials, chalcogenide glass may utilize higher current and voltage to implement the reconfiguration which results in a resistance change from approximately $10^4$ Ω in an amorphous state to approximately $10^2$ Ω in a crystalline state. Additional details regarding usage of chalcogenide glass are described in "Nonvolatile Memory Based on Phase Transition in Chalcogenide Thin Film;" K. Nakayama et al.; Jpn. Appl. Phys., Vol 32; 1993; p 564, the teachings of which are incorporated herein by reference.

Other implementations of configurable portion 32*a* are possible. In some embodiments, the configurable portion 32*a* may not merely comprise a series electrical connection intermediate two respective circuits including processing circuitry 30 and antenna 34. For example, if a suitable material changes from an open circuit before reconfiguration to a closed circuit after reconfiguration, the configurable portion 32*a* may be used to control a transistor (not shown) or other device or circuit which provides a closed circuit connection of processing circuitry 30 and antenna 34 prior to reconfiguration and an open circuit after reconfiguration of the configurable portion 32*a*. As mentioned above, configurable portion 32*a* may be coupled with or comprise a capacitor usable to implement the reconfiguration responsive to electromagnetic or other energy received by devices 14*a*. Other embodiments are possible and configurable portion 32*a* may be arranged in any appropriate configuration to provide desired deactivation of device 14*a*.

Figure 6:
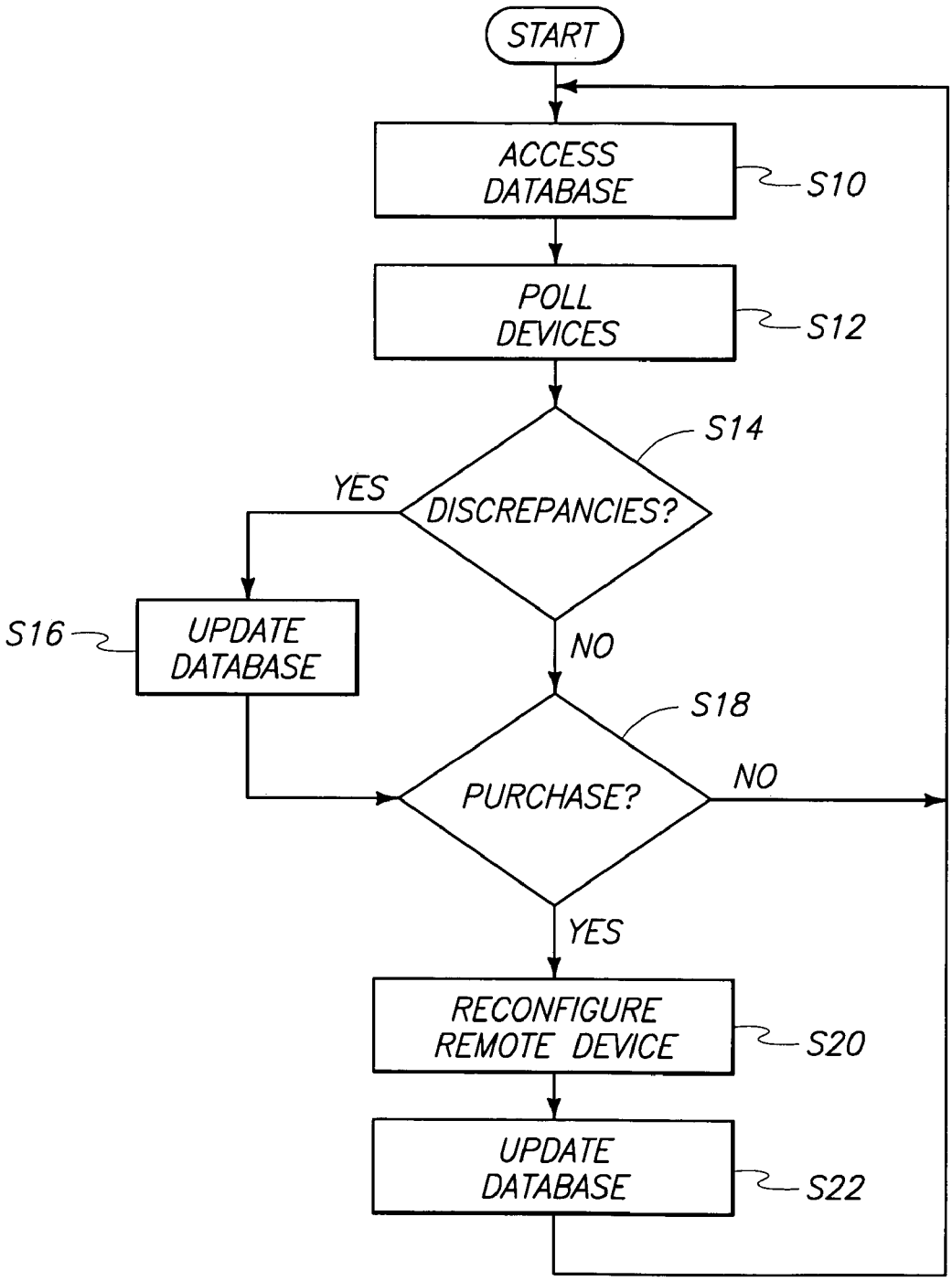
FIG. 6 is a flow chart of an exemplary operational method of a wireless communications system according to one embodiment.

Referring to FIG. 6, a methodology is illustrated corresponding to exemplary operations of base station 12 in a retail store embodiment. The illustrated method may be implemented using processing circuitry 22 of base station 12 in one implementation. Other methods are possible including more, less or alternative steps.

At a step S10, the processing circuitry may access a database identifying the retail articles and respective remote communications devices which are considered to be present in the store.

At a step S12, the processing circuitry may issue a polling signal to check inventory in the retail store.

At a step S14, the processing circuitry may receive identification signals from at least some of the remote communications devices and compare the received signals with the contents of the database to identify any discrepancies between the responding remote communications devices and the contents of the database.

If a discrepancy is found, the method may proceed to step S16 wherein the processing circuitry may update the database including removing or adding a given device with respect to the database. In addition, the processing circuitry may also signal or indicate the presence of the discrepancy to a user.

At a step S18, the processing circuitry determines whether a retail article is presented for purchase.

If not, the method may return to step S10.

If a retail article is presented for purchase, the processing circuitry may proceed to step S20 to reconfigure the respective remote communications device of the presented retail article to render the respective remote communications device insensitive to wireless interrogation and other signals of the base station. For example, at step S20, the processing circuitry may control the base station to emit electromagnetic energy of the increased energy level to reconfigure the device. In another arrangement, the processing circuitry may control the user interface of the base station to instruct a retail clerk to remove the removable portion 44 of the substrate 40 to reconfigure the remote communications device. Other operations are possible to implement the reconfiguration of the device in other embodiments.

At a step S22, the processing circuitry may remove the reconfigured remote communications device from the database indicating the expected future non-responsiveness of the device to future interrogation or other communications.

The protection sought is not to be limited to the disclosed embodiments, which are given by way of example only, but instead is to be limited only by the scope of the appended claims.

What is claimed is:

1. A remote communications device comprising:

communications circuitry configured to implement wireless communications with respect to another wireless communications device; and a configurable portion configured to be altered, and wherein the remote communications device is configured to respond to wireless interrogation signals from the another wireless communications device and incident at the remote communications device with the configurable portion in an unaltered condition, and wherein the remote communications device is insensitive to the wireless interrogation signals from the another wireless communications device and incident at the remote communications device with the configurable portion in an altered condition.

2. The device of claim 1 wherein the configurable portion comprises electrical circuitry configured to implement the wireless communications.

3. The device of claim 1 further comprising a substrate, and wherein the configurable portion comprises an integral portion of the substrate in the unaltered condition and a removed portion of the substrate in the altered condition.

4. The device of claim 3 wherein a portion of the communications circuitry is coupled with the removed portion of the substrate.

5. The device of claim 4 wherein the portion of the communications circuitry comprises an antenna.

6. The device of claim 3 wherein the integral portion of the substrate is physically coupled with another portion of the substrate and the removed portion of the substrate is physically separated from the another portion of the substrate.

7. The device of claim 1 wherein the configurable portion comprises a fusable link providing one of an open and a closed circuit in the unaltered condition and an other of the open and closed circuit in the altered condition.

8. The device of claim 7 further comprising an antenna, and wherein electromagnetic energy received via the antenna is configured to alter the configurable portion from the unaltered condition to the altered condition.

9. The device of claim 8 wherein the electromagnetic energy has a characteristic different than electromagnetic energy of the wireless interrogation signals.

10. The device of claim 1 wherein the communications circuitry is sensitive to electromagnetic energy having a characteristic of the wireless interrogation signals with the configurable portion in the unaltered condition and insensitive to the electromagnetic energy having the characteristic of the wireless interrogation signals with the configurable portion in the altered condition.

11. The device of claim 1 wherein the communications circuitry is configured to output wireless identification signals to respond to the wireless interrogation signals, and wherein the wireless identification signals identify the remote communications device.

12. The device of claim 11 wherein the communications circuitry is configured to backscatter modulate radio frequency energy to output the wireless identification signals.

13. The device of claim 1 wherein the altered condition is permanent.

14. The device of claim 1 wherein the communications circuitry is configured to implement radio frequency identification device (RFID) wireless communications.

15. The device of claim 1 further comprising a substrate configured to couple with an article.

16. The device of claim 15 further comprising the article.

17. The device of claim 1 wherein no information is communicated between the remote communications device and the wireless communications device when the remote communications device is insensitive to the wireless interrogation signals.

18. A wireless communications system comprising:

a base station configured to output wireless interrogation signals and to receive wireless identification signals responsive to the outputting of the wireless interrogation signals; and a plurality of remote communications devices remotely located with respect to the base station, and wherein individual ones of the remote communications devices comprise:

communications circuitry configured to implement wireless communications with respect to the base station; and a configurable portion configured to be altered, and wherein the respective remote communications device is configured to output the wireless identification signals responsive to the wireless interrogation signals incident at the remote communications device with the configurable portion in an unaltered condition, and wherein the respective remote communications device is configured to not respond to the wireless interrogation signals incident at the remote communications device with the configurable portion in an altered condition.

19. The system of claim 18 wherein the configurable portion comprises electrical circuitry configured to implement the wireless communications.

20. The system of claim 18 further comprising a substrate, and wherein the configurable portion comprises an integral portion of the substrate in the unaltered condition and a removed portion of the substrate in the altered condition.

21. The system of claim 20 wherein the substrate is configured to couple with an article.

22. The system of claim 20 wherein the integral portion of the substrate is physically coupled with another portion of the substrate and the removed portion of the substrate is physically separated from the another portion of the substrate.

23. The system of claim 20 wherein a portion of the communications circuitry is coupled with the removed portion of the substrate.

24. The system of claim 23 wherein the portion of the communications circuitry comprises an antenna.

25. The system of claim 18 wherein the configurable portion comprises a fusable link providing one of an open and a closed circuit in the unaltered condition and an other of the open and closed circuit in the altered condition.

26. The system of claim 25 further comprising an antenna, and wherein electromagnetic energy received via the antenna is configured to alter the configurable portion from the unaltered condition to the altered condition.

27. The system of claim 18 wherein the communications circuitry is sensitive to electromagnetic energy having a characteristic of the wireless interrogation signals with the configurable portion in the unaltered condition and insensitive to the electromagnetic energy having the characteristic of the wireless interrogation signals with the configurable portion in the altered condition.

28. The system of claim 18 wherein the altered condition is permanent.

29. The system of claim 18 wherein no information is communicated between the respective one of the remote communications devices and the base station when the configurable portion is in the altered condition.

30. A remote communications device operable method comprising:

providing a remote communications device;

receiving a plurality of wireless interrogation signals from a base station using the remote communications device present within a communications range of the base station;

using the remote communications device in an unaltered configuration, outputting a plurality of wireless identification signals responsive to the receiving of the wireless interrogation signals;

reconfiguring the remote communications device from the unaltered configuration to an altered configuration after the outputting; and wherein the reconfiguring to the altered configuration renders the remote communications device insensitive to the wireless interrogation signals received by the remote communications device while the remote communications device is present within the communications range of the base station.

31. The method of claim 30 wherein the providing comprises providing the remote communications device comprising a substrate, and the reconfiguring comprises removing a portion of the substrate.

32. The method of claim 31 wherein the removing comprises removing a portion of wireless communications circuitry of the remote communications device.

33. The method of claim 32 wherein the removing the portion of the wireless communications circuitry comprises physically separating an antenna attached to the removed portion of the substrate from a remaining portion of the wireless communications circuitry.

34. The method of claim 31 wherein the portion of the substrate comprises a first portion, and the removing comprises physically separating the first portion from a second portion of the substrate.

35. The method of claim 30 wherein the reconfiguring comprising altering a fusable link from one of an open and a closed circuit to an other of the open and the closed circuit.

36. The method of claim 35 further comprising receiving electromagnetic energy using an antenna of the remote communications device, and the reconfiguring is responsive to the receiving.

37. The method of claim 36 wherein the electromagnetic energy has a characteristic different than electromagnetic energy of the wireless interrogation signals.

38. The method of claim 30 wherein the remote communications device is sensitive to electromagnetic energy having a characteristic of the wireless interrogation signals before the reconfiguring and insensitive to the electromagnetic energy having the characteristic of the wireless interrogation signals after the reconfiguring.

39. The method of claim 30 wherein the reconfiguring comprises permanently reconfiguring the remote communications device.

40. The method of claim 30 further comprising coupling the remote communications device with an article.

41. The method of claim 30 wherein no information is communicated between the remote communications device and the base station when the remote communications device is in the altered condition.

* * * * *